US009725669B2

(12) United States Patent
Aswath et al.

(10) Patent No.: US 9,725,669 B2
(45) Date of Patent: Aug. 8, 2017

(54) SYNERGISTIC MIXTURES OF IONIC LIQUIDS WITH OTHER IONIC LIQUIDS AND/OR WITH ASHLESS THIOPHOSPHATES FOR ANTIWEAR AND/OR FRICTION REDUCTION APPLICATIONS

(71) Applicants: Pranesh Aswath, Grapevine, TX (US); Xin Chen, Dallas, TX (US); Vibhu Sharma, Arlington, TX (US); Maria Amaya Igartua, Eibar (ES); Francesco Pagano, Eibar (ES); Wolfgang Binder, Halle (ES); Parvin Zare, Halle (DE); Nicole Doerr, Wiener Neustadt (AT)

(72) Inventors: Pranesh Aswath, Grapevine, TX (US); Xin Chen, Dallas, TX (US); Vibhu Sharma, Arlington, TX (US); Maria Amaya Igartua, Eibar (ES); Francesco Pagano, Eibar (ES); Wolfgang Binder, Halle (ES); Parvin Zare, Halle (DE); Nicole Doerr, Wiener Neustadt (AT)

(73) Assignee: BOARD OF REGENTS, THE UNIVERSITY OF TEXAS SYSTEM, Austin, TX (US)

( * ) Notice: Subject to any disclaimer, the term of this patent is extended or adjusted under 35 U.S.C. 154(b) by 126 days.

(21) Appl. No.: 13/889,037

(22) Filed: May 7, 2013

(65) Prior Publication Data

US 2013/0331305 A1 Dec. 12, 2013

Related U.S. Application Data

(60) Provisional application No. 61/643,681, filed on May 7, 2012.

(51) Int. Cl.
*C10M 141/10* (2006.01)
*C10M 141/08* (2006.01)

(52) U.S. Cl.
CPC ..... *C10M 141/10* (2013.01); *C10M 141/08* (2013.01); *C10M 2215/04* (2013.01);
(Continued)

(58) Field of Classification Search
CPC ..... C10M 141/08; C10M 141/10; C10M 2215/04; C10M 2215/042;
(Continued)

(56) References Cited

U.S. PATENT DOCUMENTS 2,167,784 A 8/1939 Svendsen
2,230,654 A 1/1941 Plunkett
(Continued)

FOREIGN PATENT DOCUMENTS

CN 101768121 A * 7/2010
EP 0856570 8/1998
(Continued)

OTHER PUBLICATIONS

Parekh et al. "Synthesis of Fluorinated ZDDP Compounds", Tribol Lett, 34:141-153 (2009).

*Primary Examiner* — James Goloboy
(74) *Attorney, Agent, or Firm* — Parks IP Law LLC

(57) ABSTRACT

Anti-wear and/or friction reducing formulations that include a mixture of at least one first ionic liquid and at least one ashless antiwear compound. The ashless antiwear compound can be a second ionic liquid or an ashless thiophosphate compound. The formulation desirably provides synergistic anti-wear and/or friction reducing properties. The first IL can be a monocationic ionic liquid or a dicationic ionic liquid. The second IL is a dicationic ionic liquid. The ashless thiophosphate is desirably a thiophosphate, such as a fluorothiophosphate (FTP), an alkylphosphorofluoridothiolate, or an alkylthioperoxydithiophosphate. Antiwear and/or fric-
(Continued)

tion reduction formulations comprising the above mixtures diluted up to 25% by weight in a base oil.

20 Claims, 9 Drawing Sheets

(52) U.S. Cl.
CPC . *C10M 2215/042* (2013.01); *C10M 2215/221* (2013.01); *C10M 2215/223* (2013.01); *C10M 2215/224* (2013.01); *C10M 2219/044* (2013.01); *C10M 2219/082* (2013.01); *C10M 2223/04* (2013.01); *C10M 2223/047* (2013.01); *C10M 2223/06* (2013.01); *C10N 2220/04* (2013.01); *C10N 2230/06* (2013.01); *C10N 2230/08* (2013.01)

(58) Field of Classification Search
CPC ..... C10M 2215/221; C10M 2215/223; C10M 2215/224; C10M 2219/044; C10M 2219/082; C10M 2223/04; C10M 2223/047; C10M 2223/06; C10N 2220/04; C10N 2230/06; C10N 2230/08
USPC ..... 508/388, 438
See application file for complete search history.

(56) References Cited

U.S. PATENT DOCUMENTS 2,510,112 A 6/1950 Holbrook
2,624,713 A 1/1953 Hurley
2,884,431 A 4/1959 Smith et al.
2,904,398 A 9/1959 Smith
2,924,508 A 2/1960 Gililand et al.
2,952,514 A 9/1960 Smith
2,959,544 A 11/1960 Smith et al.
2,993,567 A 7/1961 Schachner
3,097,063 A 7/1963 Gililand et al.
3,114,889 A 12/1963 Christian
3,194,762 A 7/1965 Browning et al.
3,247,116 A 4/1966 Relling
3,432,431 A 3/1969 Mitacek
3,493,513 A 2/1970 Petriello
3,505,229 A 4/1970 Skehan
3,536,624 A 10/1970 Christian et al.
3,567,521 A 3/1971 Toy et al.
3,592,700 A 7/1971 Toy
3,607,747 A 9/1971 Ishikawa
3,636,172 A 1/1972 Gardner
3,640,859 A 2/1972 Messina et al.
3,656,700 A 4/1972 Gauvin
3,720,722 A 3/1973 Wada et al.
3,723,317 A 3/1973 Ulery
3,750,911 A 8/1973 Ebner et al.
3,806,455 A 4/1974 Siegart et al.
3,909,431 A 9/1975 Figiel
3,933,656 A 1/1976 Reick
3,969,233 A 7/1976 Lucas
4,012,493 A 3/1977 Layne et al.
4,021,530 A 5/1977 Layne et al.
4,029,870 A 6/1977 Brown et al.
4,034,070 A 7/1977 Wojtowicz et al.
4,036,718 A 7/1977 Brown et al.
4,052,323 A 10/1977 Feneberger et al.
4,127,491 A 11/1978 Reick
4,130,492 A 12/1978 Longo et al.
4,224,173 A 9/1980 Reick
4,252,678 A 2/1981 Smith
4,313,761 A 2/1982 Joyce et al.
4,349,444 A 9/1982 Reick
4,363,737 A 12/1982 Rodriguez
4,405,469 A 9/1983 Hafner
4,465,607 A 8/1984 Cottell
4,484,954 A 11/1984 Tarancon
4,500,678 A 2/1985 Kita et al.
4,545,964 A 10/1985 Bergez et al.
4,584,116 A 4/1986 Hermant et al.
4,615,917 A 10/1986 Runge
4,638,444 A 1/1987 Laragione et al.
4,657,687 A 4/1987 Caporiccio et al.
4,741,893 A 5/1988 Watanabe et al.
4,764,056 A 8/1988 Zentgraf et al.
4,770,797 A 9/1988 Syracuse et al.
4,803,005 A 2/1989 Juhlke et al.
4,824,690 A 4/1989 Heinecke et al.
4,832,859 A 5/1989 Basset et al.
4,834,894 A 5/1989 Scheld
4,857,294 A 8/1989 Bridenne Alaux et al.
4,857,492 A 8/1989 Bradley et al.
4,859,357 A 8/1989 Germanaud et al.
4,888,122 A 12/1989 McCready
4,892,669 A 1/1990 Marcora et al.
4,917,872 A 4/1990 Nakahara et al.
4,938,945 A 7/1990 Mahmood et al.
4,983,373 A 1/1991 Withers, Jr. et al.
5,004,554 A 4/1991 Tohzuka et al.
5,009,963 A 4/1991 Ohmi et al.
5,096,145 A 3/1992 Phillips et al.
5,110,657 A 5/1992 Ainslie
5,116,900 A 5/1992 Flautt et al.
5,118,434 A 6/1992 Meyer et al.
5,133,886 A 7/1992 Hata
5,160,646 A 11/1992 Scheid
5,188,747 A 2/1993 Kai et al.
5,227,081 A 7/1993 Sawa et al.
5,242,506 A 9/1993 Barber et al.
5,286,882 A 2/1994 Zuzich et al.
5,350,727 A 9/1994 Tsurumi et al.
5,373,986 A 12/1994 Rafferty et al.
5,380,557 A 1/1995 Spiro
5,385,683 A 1/1995 Ransom
5,447,896 A 9/1995 Rao
5,460,661 A 10/1995 Maynard, Jr.
5,595,791 A 1/1997 Baumgart et al.
5,595,962 A 1/1997 Caporiccio et al.
5,698,483 A 12/1997 Ong et al.
5,767,045 A 6/1998 Ryan
5,877,128 A 3/1999 Greer
6,045,692 A 4/2000 Bilski et al.
6,080,899 A 6/2000 Bradley et al.
6,152,978 A 11/2000 Lundquist
6,258,758 B1 7/2001 Greer
6,316,377 B1 11/2001 Fulton et al.
6,361,678 B1 3/2002 Childs et al.
6,362,135 B1 3/2002 Greer
6,413,918 B1 7/2002 Beatty et al.
6,436,362 B1 8/2002 Cuzzato
6,541,430 B1 4/2003 Beatty
6,630,610 B2 10/2003 Swain et al.
6,642,186 B2 11/2003 Beatty et al.
6,734,320 B2 5/2004 Beatty et al.
6,764,984 B2 7/2004 Beatty
6,835,218 B1 12/2004 Drozd et al.
6,955,793 B1 10/2005 Arencibia et al.
6,960,555 B2 11/2005 Anthony et al.
7,074,745 B2 7/2006 Shaub et al.
7,592,287 B2 9/2009 Kemnitz et al.
7,754,662 B2 7/2010 Aswath et al.
7,879,776 B2 2/2011 Patel et al.
2001/0038048 A1 11/2001 Blanton
2003/0139300 A1 7/2003 Beatty
2005/0119135 A1 6/2005 Shaub et al.
2006/0014652 A1 1/2006 Parekh et al.
2006/0040832 A1 2/2006 Zhang
2006/0063683 A1 3/2006 Parekh et al.
2006/0281644 A1* 12/2006 Aswath et al. ..... 508/369
2007/0093397 A1 4/2007 Patel et al.
2008/0027231 A1* 1/2008 Armstrong et al. ..... 548/313.7
2010/0093577 A1* 4/2010 Ritchie ..... C10M 129/40 508/388
2010/0137175 A1* 6/2010 Kunz et al. ..... 508/463

(56) References Cited

U.S. PATENT DOCUMENTS

| | | | | |
|---|---|---|---|---|
| 2011/0092399 | A1* | 4/2011 | Schmidt-Amelunxen et al. | 508/128 |
| 2011/0319303 | A1* | 12/2011 | Chen et al. | 508/183 |
| 2013/0296598 | A1* | 11/2013 | Aswath et al. | 558/129 |

FOREIGN PATENT DOCUMENTS

| | | |
|---|---|---|
| GB | 804777 | 11/1958 |
| JP | 10287402 | 10/1998 |
| WO | WO 2011026990 A1 * | 3/2011 |

* cited by examiner

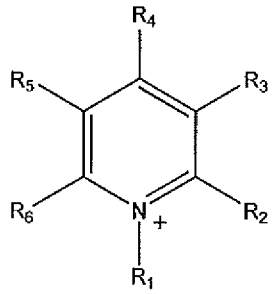
Pyridinium
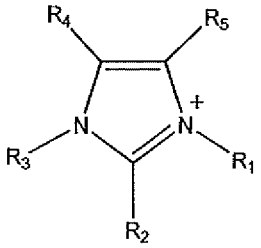
Imidazolium
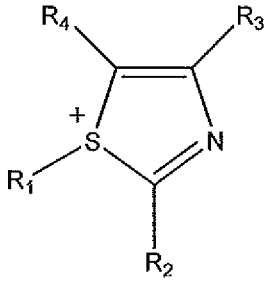
Thiazolium
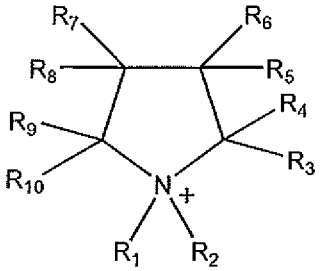
Imidazolidinium
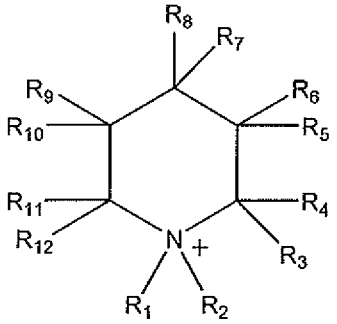
Piperidinium
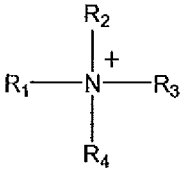
Ammonium
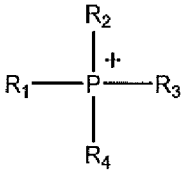
Phosphonium
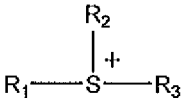
Sulfonium
FIGURE 2

| Compound names | Compound structure |
|---|---|
| Butylphosphoro fluoridothioate | 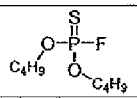 |
| *iso*-Butylphosphoro fluoridothioate | 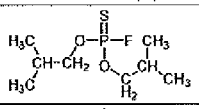 |
| 1-Methylpropylphosphoro fluoridothioate | 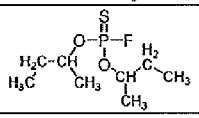 |
| 1-Methylbutylphosphoro fluoridothioate | 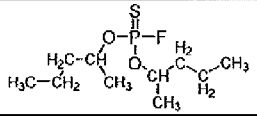 |
| 1,3-Dimethylbutylphos phorofluoridothioate | 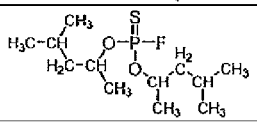 |
| 2-Ethylhexylphosphoro fluoridothioate | 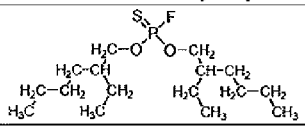 |
| Octylphosphoro fluoridothioate | 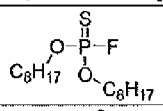 |
| 1-Methylheptylphosphoro fluoridothioate | 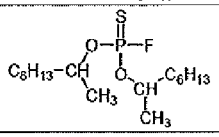 |
| Tridecylphosphoro fluoridothioate | 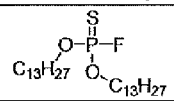 |
| 1-Methyldodecylphosphoro fluoridothioate | 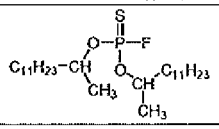 |
| Tetradecylphosphoro fluoridothiate | 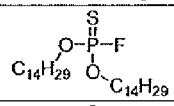 |
| Octadecylphosphoro fluoridothioate | 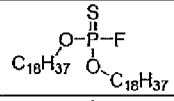 |
| Docosylphosphoro fluoridothioate | 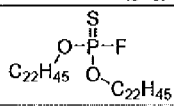 |

FIGURE 3

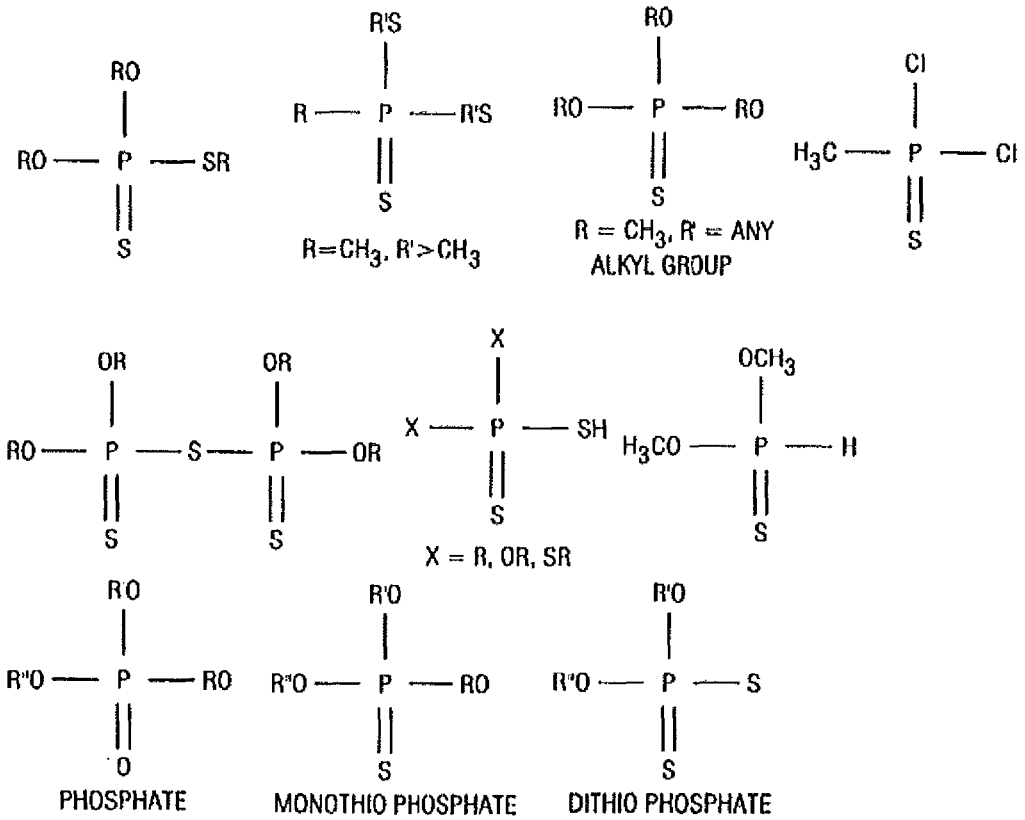
R, R', R" may be all equal or different
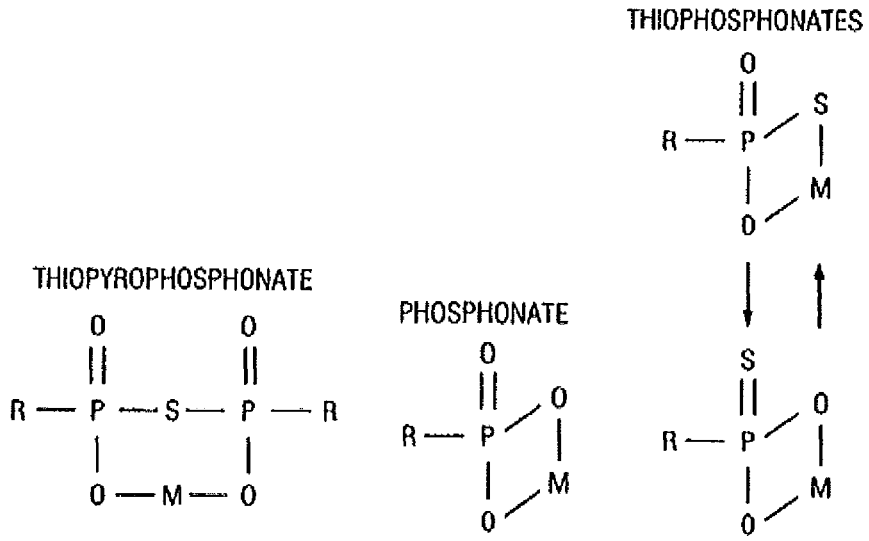
FIGURE 4

SYNERGISTIC MIXTURES OF IONIC LIQUIDS WITH OTHER IONIC LIQUIDS AND/OR WITH ASHLESS THIOPHOSPHATES FOR ANTIWEAR AND/OR FRICTION REDUCTION APPLICATIONS

CROSS REFERENCE TO RELATED APPLICATIONS

This application claims priority to provisional application 61/643,681 filed on May 7, 2012.

BACKGROUND OF THE INVENTION

This invention is in the field of tribology, more specifically formulations which provide good antiwear and beneficial friction properties.

Ionic liquids (ILs) are a new generation of antiwear additives that are superior to traditional antiwear additives such as ZDDP. Ionic liquids are most commonly defined as organic salts with melting points or glass transition temperature below 100° C. Although this description gives a clear idea of their ionic nature and their liquid state at a relatively low temperature, it is worthwhile to stress the importance of ILs in comparison to molten salts. Usually, fusion temperature of a salt is considerably high, for example 801° C. in the case of sodium chloride, which excludes its use in many applications. However, by the use of ILs, it is possible to benefit from properties emerging from ionic bonds between the moieties, but at a relatively low temperature, often significantly below room temperature. The provision and maintenance of these properties are in particular important for their use as lubricants to enable application over a wider range of temperature.

In order to decrease the melting temperature, ILs are generally constituted from an organic cation with low symmetry and a weakly coordinated anion. This way, lattice energy is lower and the anion-cation interaction is minimized due to the asymmetric and delocalized charge.

The reason for the growing interest in ILs can be explained by their excellent physical-chemical properties such as their large electrochemical window, controlled miscibility, high thermal stability, negligible vapor pressure, and in some cases, environmental harmlessness. In addition to these qualities, it is possible to obtain compounds with tailor-designed properties by tuning the structure through substitution and structural modification of the anion or of the cation. For example, changes in the anion can influence the chemical behavior and the stability of the IL while the use of different cations can affect physical properties, such as viscosity, melting point, and density.

In 2001, Ye et al. performed the first tribological investigation with ILs. C. Ye, W. Liu, Y. Chen, L. Yu: "Room-temperature ionic liquids: a novel versatile lubricant". Chem. Commun., (2001), 2244-2245. This research group used imidazolium tetrafluoroborate as a lubricant for various tribo-pairs and, in all the experiments, the use of ILs showed significant friction reduction. After this initial research, many other researchers have studied the tribological behavior of ILs and the number of chemical structures investigated and papers published on this topic grows rapidly every year. In addition, dicationic ILs (DILs) have been investigated for their tribological behavior and showed good performances. The thermal stabilities of DILs are generally greater than those of most traditional monocationic ILs.

Zinc dialkyl dithiophosphates (ZDDPs) are the most common additives used in hydraulic, gear, and engine oils. The use of ZDDPs, however, presents disadvantages. For example, ash generation by ZDDPs is dangerous for engine oils, since it reduces significantly the durability of the after treatment system installed in the exhaust system to reduce undesired emissions, mainly carbon monoxide, unburned hydrocarbons, and oxides of nitrogen, generated in the engine.

Ashless thiophosphates also have been shown to exhibit superior wear performance, and have been shown to be superior to ZDDP in some aspects. U.S. Pat. Nos. 7,074,745 and 8,216,982 and Publication No. 2011/0319303 disclose ashless fluorothiophosphates. In addition, alkylthioperoxydithiophosphates are described in U.S. patent application Ser. No. 13/887,968, filed on May 6, 2013.

SUMMARY OF THE INVENTION

The present disclosure is directed to anti-wear and/or friction reducing formulations that include a mixture of at least one first ionic liquid and at least one ashless antiwear compound. The ashless antiwear compound can be a second ionic liquid or an ashless thiophosphate compound. The formulation desirably provides synergistic anti-wear and/or friction reducing properties.

The first IL can be a monocationic ionic liquid or a dicationic ionic liquid. The second IL is a dicationic ionic liquid. The ashless thiophosphate is desirably a thiophosphate, such as a fluorothiophosphate (FTP), an alkylphosphorofluoridothiolate, or an alkylthioperoxydithiophosphate.

The mixtures contain the ashless compound in an amount from 1 to 25% by weight.

The present disclosure further is directed to antiwear and/or friction reduction formulations comprising the above mixtures diluted up to 25% by weight in a base oil.

The present disclosure is moreover directed to using the above described mixtures and formulations as antiwear and/or friction reducing agents either in neat form or as combined with base oils.

Mixtures of ionic liquids provide higher friction and wear reduction than single ILs, both as neat lubricants and as additives in base oil. Often this improvement in antiwear and friction reducing properties is greater when increasing the temperature. In general, longer chain lengths yielded better tribological behavior and higher ionic liquid corrosion resistance. Improvement of the IL mixture was also effective when the mixture was diluted at an overall amount of 1% in a base oil. The anion has a bigger influence than the cation in thermal properties, and the IL mixture does not significantly reduce the best thermal resistance.

In addition, blends of IL with ashless thiophosphates also exhibit superior wear and friction performance when compared with each of the constituent compounds alone. The mixtures are compatible with traditional additives used in engine oil such as antioxidants and detergents. These mixtures have the potential to replace ZDDP as they are ashless in nature, stable, and compatible with existing additive packages and are reasonably priced. These additives have application in a range of consumer and industrial products including engine oils/transmission oils/gear oils for automobiles and commercial vehicles. Since the ionic liquids have a very low evaporation rate, they can reduce the evaporation of lubricant in the engine caused by the high temperatures. Additionally, this property makes them promising as lubricants and greases for vacuum applications.

While the mixtures contain phosphorus and sulfur they do not contain metal cations. In addition, they are very polar (both the ionic fluids as well as the fluorothiophosphates) and have a much greater affinity to metal surfaces and provide improved wear performance compared to ZDDP. The IL mixtures may be used at lower levels of phosphorus and sulfur compared to ZDDP and have the potential to reduce the extent of deposits on catalytic convertors and hence resulting in reduced undesired emissions from internal combustion engines. The ionic liquids can exhibit very high thermal stability up to more than 400° C. as determined by thermal analysis, making them good candidates for formulations that need high thermal resistance and low evaporation rates.

BRIEF DESCRIPTION OF THE DRAWINGS

FIG. 2 illustrates examples of cations that are used in ionic liquids.

FIG. 3 illustrates examples of fluorothiophosphates.

DETAILED DESCRIPTION OF THE INVENTION

Figure 1:
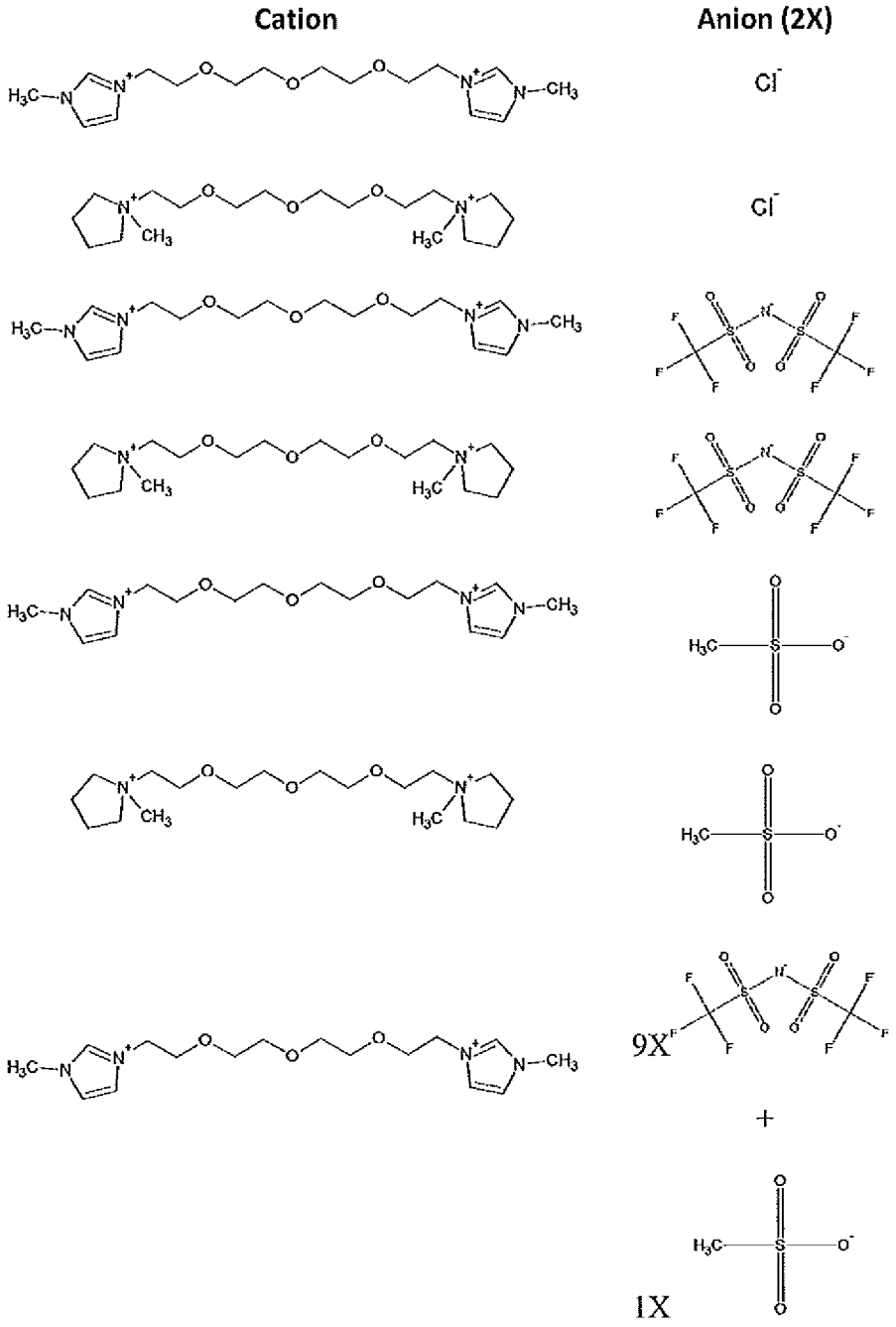
FIG. 1 illustrates examples of dicationic ionic liquids.
Figure 1:
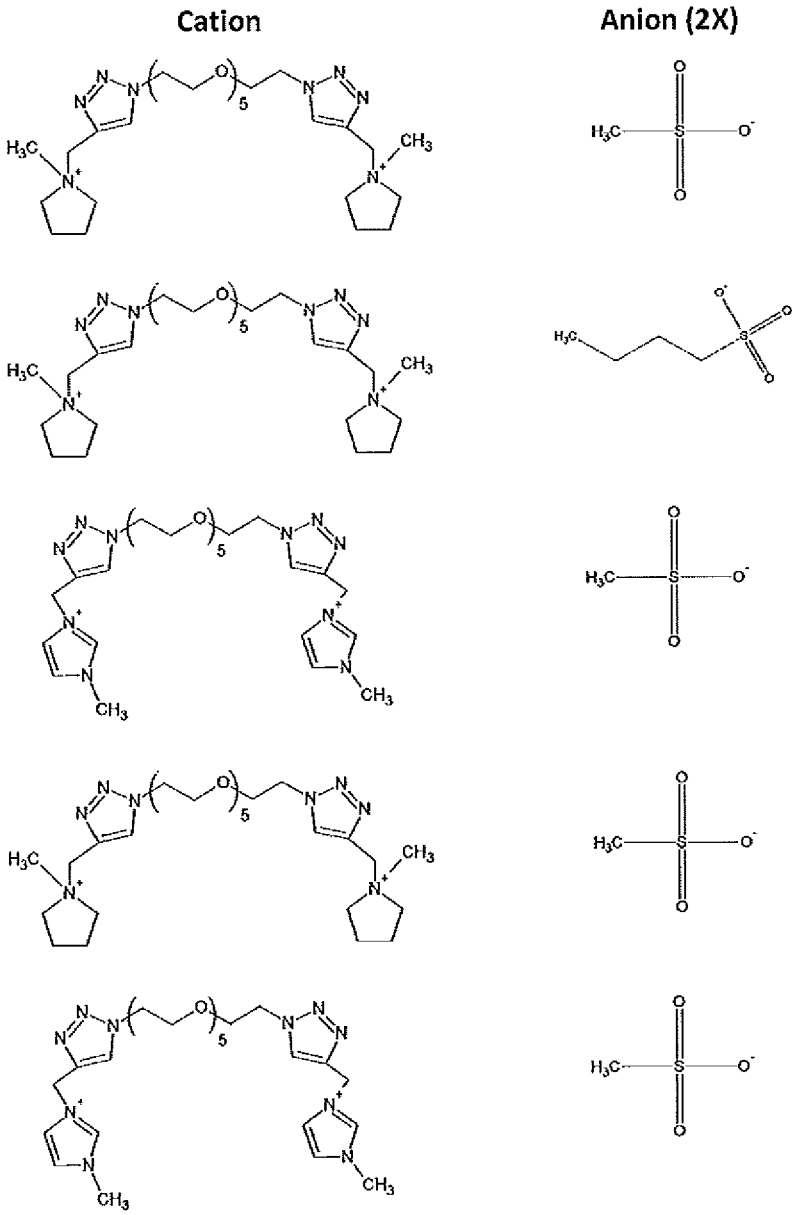

The present disclosure may take form in various components and arrangements of components, and in various process operations and arrangements of process operations. The present disclosure is illustrated in the accompanying drawings, throughout which like reference numerals may indicate corresponding or similar parts in the various figures. The drawings are only for purposes of illustrating preferred embodiments and are not to be construed as limiting the disclosure. Given the following enabling description, the novel aspects of the present disclosure should become evident to a person of ordinary skill in the art.

In the description below, ionic liquids generally are referred to as ionic liquids or ILs. Monocationic ionic liquids specifically are called MILs and dicationic ionic liquids (ionic pair at both ends) specifically are termed DILs. The invention comprises synergistic mixtures of a) ionic liquids and b) ionic liquids with ashless thiophosphate compounds. The mixtures are useful as antiwear and friction reduction compounds, both as undiluted neat formulations and when diluted with base oils.

Ionic Liquids

The general structures of monocationic ionic (MILs) and dicationic ionic liquids (DILs) are schematically presented as follows:

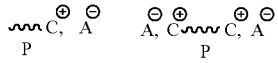

P: chain
$C^{\oplus}$: cation
$A^{\ominus}$: anion

R denotes in all cases a substituent. Some examples of DILs are shown in FIG. 1. FIG. 2 illustrates cations commonly used in ILs.

C represents the same or different cations including, but not limited to, pyridinium, pyridazinium, pyrimidinium, pyrazinium, imidazolium, 1H-pyrazolium, 3H-pyrazolium, 4H-pyrazolium, 1-pyrazolinium, 2-pyrazolinium, 3-pyrazolinium, 2,3-dihydroimidazolium, 4,5-dihydroimidazolinium, 2,5-dihydroimidazolinium, thiazolium, oxazolium, 1,2,4-triazolium, 1,2,3-triazolium, pyrrolium, pyrrolidinium, imidazolidinium, pyrrolidinonium, ammonium ($R_1R_2R_3R_4N^+$, $R_1R_2R_3HN^+$, $R_1R_2H_2N^+$, $R_1H_3N^+$, $H_4N^+$), phosphonium, sulfonium, indolinium, quinolinium, isoquinolinium, quinoxalinium, benzimidazolium, acridinium, benzothiophenium, benzotriazolium, benzoxazinium, isoxazolium, morpholinium, benzoxadiazolium, benzoxazolium, 2-oxazolidinium, piperazinium, piperidinium, purinium, benzotriazolium, tetrazolium, thiadiazolium, thiomorpholinium, thiophenium, thiopyranium, thiouronium, uranium, guanidinium, 1,3-selenazolium, 1,3-azaphospholium, 1,2,4-diazaphospholium, diphosphorazolium, 1,3-thiaphospholium, 1,3-oxaphospholium, 1,3-selenphospholium, 1,3-phospholium, 1,3,4-azaphospholium, 1,3,4-diazaphospholium, 1,3,4-azadiphospholium, 1,3,4-triphospholium.

The most commonly used cations are ammonium, phosphonium, pyrrolidinium, piperidinium, imidazolium, and pyridinium.

A comprises at least one anion which can be chosen from the group halogenids, like $Cl^-$, $F^-$, $Br^-$ and $I^-$, halogenphosphates, such as $[PF_6]^-$, halogenarsenates, such as $[AsF_6]^-$, $[AsF_3]^-$ and halogenantimonates, such as $[SbF_6]^-$; anions can be used such as: $[SO_4]^{2-}$, $[R_1SO_4]^-$, $[S_2O_8]^{2-}$, $[R_1S_2O_8]^-$, $[SO_3]^{2-}$, $[R_1SO_3]^-$, $[SO_2]^{2-}$, $[R_1SO_2]^-$, $[SO_5]^{2-}$, $[R_1SO_5]^-$, $[S]^{2-}$, $[R_1S]^-$, $[SCN]^-$, $[R_1OSO_3]^-$, $[CF_3SO_3]^-$, $[CF_3CF_2SO_3]^-$, $[CF_3CF_2CF_2SO_3]^-$, $[CF_3CF_2CF_2CF_2SO_3]^-$, $[CF_3(CF_2)_nSO_3]^-$, with n from 4 to 30, $[HCF_2CF_2SO_3]^-$, $[CF_3CHFCF_2SO_3]^-$, $[HCClFCF_2SO_3]^-$, $[HCF_2CF_2SO_3]^-$, $[CF_3OCHFCF_2SO_3]^-$, $[CF_3CF_2OCHFCF_2SO_3]^-$, $[CF_3CHFOCF_2CF_2SO_3]^-$, $[HCF_2CF_2OCF_2CF_2SO_3]^-$, $[CF_2ICF_2OCF_2CF_2SO_3]^-$, $[CF_3CF_2OCF_2CF_2SO_3]^-$, carbonates such as $[CO_3]^{2-}$, $[R_1CO_3]^-$, phosphorus containing anions such as $[PO_4]^{3-}$, $[(R_1O)_2P(O)O]^-$, $[(R_1O)(R_2O)(O)O]^-$, $[(R_1S)(R_2O)P(O)O]^-$, $[(R_1O)(R_2O)P(S)O]^-$, $[(R_1O)(R_2O)P(O)S]^-$, $[(R_1)(R_2O)P(S)S]^-$, $[(R_1S)(R_2O)P(S)O]^-$, $[(R_1S)(R_2O)P(O)S]^-$, $[(R_1S)(R_2S)P(O)O]^-$, $[(R_1O)(R_2S)P(S)S]^-$, $[(R_1S)(R_2S)P(O)S]^-$, $[(R_1S)(R_2S)P(S)O]^-$, $[(R_1S)(R_2S)P(S)S]^-$, $[P(C_2F_5)_3F_3]^-$, $[P(CF_3)_3F_3]^-$, $[P(C_2HF_4)$ $(CF_3)_2F_3]^-$, $[P(C_2H_2F_3)_3F_3]^-$, $[P(C_2F_5)(CF_3)_2F_3]^-$, $[P(C_6F_5)_3F_3]^-$, $[P(C_3F_7)_3F_3]^-$, $[P(C_4F_9)_3F_3]^-$, $[P(C_2F_5)_2F_4]^-$, $[R_1R_2P(O)O]^-$, $[R_1R_2P(S)O]^-$, $[R_1R_2P(O)S]^-$, $[R_1R_2P(S)S]^-$, $[(C_2F_5)_2P(O)O]^-$, $[(CF_3)_2P(O)O]^-$, $[(C_4F_9)_2P(O)O]^-$, $[(C_2F_5)_2P(O)O_2]^{2-}$, $[P(C_2H_5)_2F_4]^-$, $[(R_1O)P(O)O_2]^{2-}$, $[(R_1S)P(O)O_2]^{2-}$, $[(R_1O)P(S)O_2]^{2-}$, $[(R_1O)P(O)OS]^{2-}$, $[(R_1S)P(S)O_2]^{2-}$, $[(R_1O)P(O)S_2]^{2-}$, $[(R_1S)P(O)OS]^{2-}$, $[(R_1O)P(S)OS]^{2-}$, $[(R_1S)P(S)OS]^{2-}$, $[(R_1O)P(S)S_2]^{2-}$, $[(R_1S)P(S)S_2]^{2-}$, $[R_1P(O)O_2]^{2-}$, $[R_1P(S)O_2]^{2-}$, $[R_1P(O)OS]^{2-}$, $[R_1P(S)OS]^{2-}$, $[R_1P)(O)S_2]^{2-}$, $[R_1P(S)S_2]^{2-}$, $[CF_3P(O)O_2]^{2-}$, $[CH_3P(O)O_2]^{2}$, $[R_1O)(R_2)P(O)O]^-$, $[(R_1S)(R_2)P(O)O]^-$, $[(R_1O)(R_2)P(S)O]^-$, $[(R_1O)(R_2)P(O)S]^-$, $[(R_1O)(R_2)P(S)S]^-$, $[(R_1S)(R_2)P(O)S]^-$, $[(R_1S)(R_2)P(S)O]^-$, $[R_1R_2P(O)O]^-$, $[R_1R_2P(S)O]^-$, $[R_1R_2P(O)S]^-$, $[R_1R_2P(S)S]^-$, $[(CH_3O)_2P(O)O]^-$, amino acid anions such as $[R_1CH(NH_2)C(O)O]^-$, carboxylates such as $[R_1C(O)O]^-$, $[CCl_3C(O)O]^-$, $[CF_3C(O)O]^-$, $[CF_3CF_2C(O)O]^-$, nitrogen containing anions such as $[NO_3]^-$, $[R_1SO_2)_2N]^-$, $[(CF_3SO_2)_2N]^-$, $[(CF_3CF_2SO_2)_2N]^-$, $[(CF_2ISO_2)_2N]^-$, $[(HCF_2CF_2SO_2)_2N]^-$, $[(CF_3CHFCF_2SO_2)_2N]^-$, $[R_1SO_2NC(O)R_2]^-$, $[R_1C(O)NC(O)R_2]^-$, $[(FSO_2)_2N]^-$, $[NR_2]^-$, $[N(CF_3)_2]^-$, $[N(CN)_2]^-$, $[N(CN)_3]^-$, boron containing anions such as $[BO_3]^{3-}$, $[(R_1O)BO_2]^{2-}$, $[(R_1O)(R_2O)BO]^-$, $[BR_1R_2R_3R_4]^-$, $[BF_3(CF_3)]^-$, $[BF_2(CF_3)_2]^-$, $[BF(CF_3)_3]^-$, $[B(CF_3)_4]^-$, $[BF_2(C_2F_5)_2]^-$, $[BF_3(C_2F_5)]^-$, $[BF(C_2F_5)_3]^-$, $[B(C_2F_5)_4]^-$, $[BF_3(CN)]^-$, $[BF_2(CN)_2]^-$, $[BF(CN)_3]^-$, $[B(CN)_4]^-$, $[BX_4]^-$, $[B(C_6H_5)_4]^-$, $[B(OR_1)_4]^-$, $[B(OCH_3)_2(OC_2H_5)_2]^-$, $[B(O_2C_2H_4)_2]^-$, $[R_1R_2BO_2]^{2-}$, $[R_1R_2BO_2]^{2-}$, $[R_1R_2BO]^-$, bis[oxalato(2-)-O,O']borate, saccharinate and silicon containing anions such as $[SiO_4]^{4-}$, $[(R_1O)SiO_3]^{3-}$, $[(R_1O)(R_2O)SiO_2]^{2-}$, $[(R_1O)(R_2O)(R_3O)SiO]^-$, $[R_1SiO_3]^{3-}$, $[R_1R_2SiO_2]^{2-}$, $[R_1R_2R_3SiO]^-$, further anions from the group of $[(R_1SO_2)_3C]^-$, $[(CF_3SO_2)_3C]^-$, $[(CF_3CF_2SO_2)_3C]^-$, $[(CN)_3C]^-$, $[R_3C]^-$, $[CF_3CO_2]^-$, $[CN]^-$, $[(R_1O(O)C)_2CR_1]^-$ can be chosen, where the substituents $R_1$ to $R_4$ are same or different, and can be hydrogen, substituted or unsubstituted linear or branched saturated or unsaturated carbon chains (preferably from 1-30 C atoms), substituted or unsubstituted aromatic or cycloaliphatic groups, which can be interrupted with heteroatoms like oxygen, sulfur, nitrogen, phosphorus and functional atom groups chosen from the following groups:—$CH_2O$—, —C(O)—, —C(O)O—, —OC(O)—, —OC(O)O—, —OC(S)O—, —OC(O)S—, —SC(O)S—, —SC(S)O—, —SC(S)S—, —C(S)—, —CH(SH)—, —C(NH)—, —$CH(NH_2)$—, —CH(OH)—, —NH—(O)C—, —NH—(O)CO—, —S(O)—, —$SO_2$—, —$SO_3$—, —N═N—, —NH—C(O)—NH—, —NH—C(S)—NH— or —$S(O_2)$—NH—; in the case of linear or branched saturated and unsaturated carbon chains as well as substituted aromatic and cycloaliphatic groups, the substituents can be chosen from the group —OH, —$NH_2$, —Cl, —F, —Br, —I, —CN, —CHN, —CSH, —COOH, —CHO, —$C(O)CH_3$, —$C(S)CH_3$, —C—S—$CH_3$, —NH—C(S)—$NH_2$, —NH—C(O)—$NH_2$, —$S(O_2)$Cl, —$S(O_2)$Br, —$S(O_2)$F, —$S(O_2)$I, —$S(O_2)$OH and C(O)X, where X for example F, Cl, Br, I, $SO_2$ or $NH_2$ is; the substituents $R_1$ to $R_4$ can also be end standing atoms or atom groups, chosen from the group —OH, —$NH_2$, —Cl, —F, —Br, I, —CN, —CHN, —CSH, —COOH, —CHO, —$C(O)CH_3$, —$C(S)CH_3$, —NH—C(S)—$NH_2$, —NH—C(O)—$NH_2$, —$S(O_2)$Cl, —$S(O_2)$Br, —$S(O_2)$F, —$S(O_2)$I and C(O)X, where X for example is F, Cl, Br, I, $SO_2$ or $NH_2$.

The most widely used anions are tetrafluoroborate, hexafluorophosphate, bis(trifluoromethylsulfonyl)imide, triflate, dialkylphosphates and dialkyldithiophosphates.

P represents a connecting chain which can be substituted or unsubstituted linear or branched saturated or unsaturated carbon chain (preferably from 1-30 C atoms), or can contain one or more of the following groups as repeating units:

Substituted or unsubstituted ether groups, preferably ethylene glycol with the number of repeating units ranging from 1 to 300, preferably 2 to 100;

Isobutylene with the number of repeating units ranging from 1 to 300;

Dimethylsiloxane with the number of repeating units ranging from 1 to 450; or n-Butylacrylate with the number of repeating units ranging from 1 to 120.

Furthermore, due to the synthetic procedure, all included ionic groups, without exception, can be attached to the connecting chain P via a triazine ring, resulting in ionic liquids which can contain one or more triazine rings incorporated between the connecting chain and ionic group.

Ashless Thiophosphate Compounds

Figure 4:
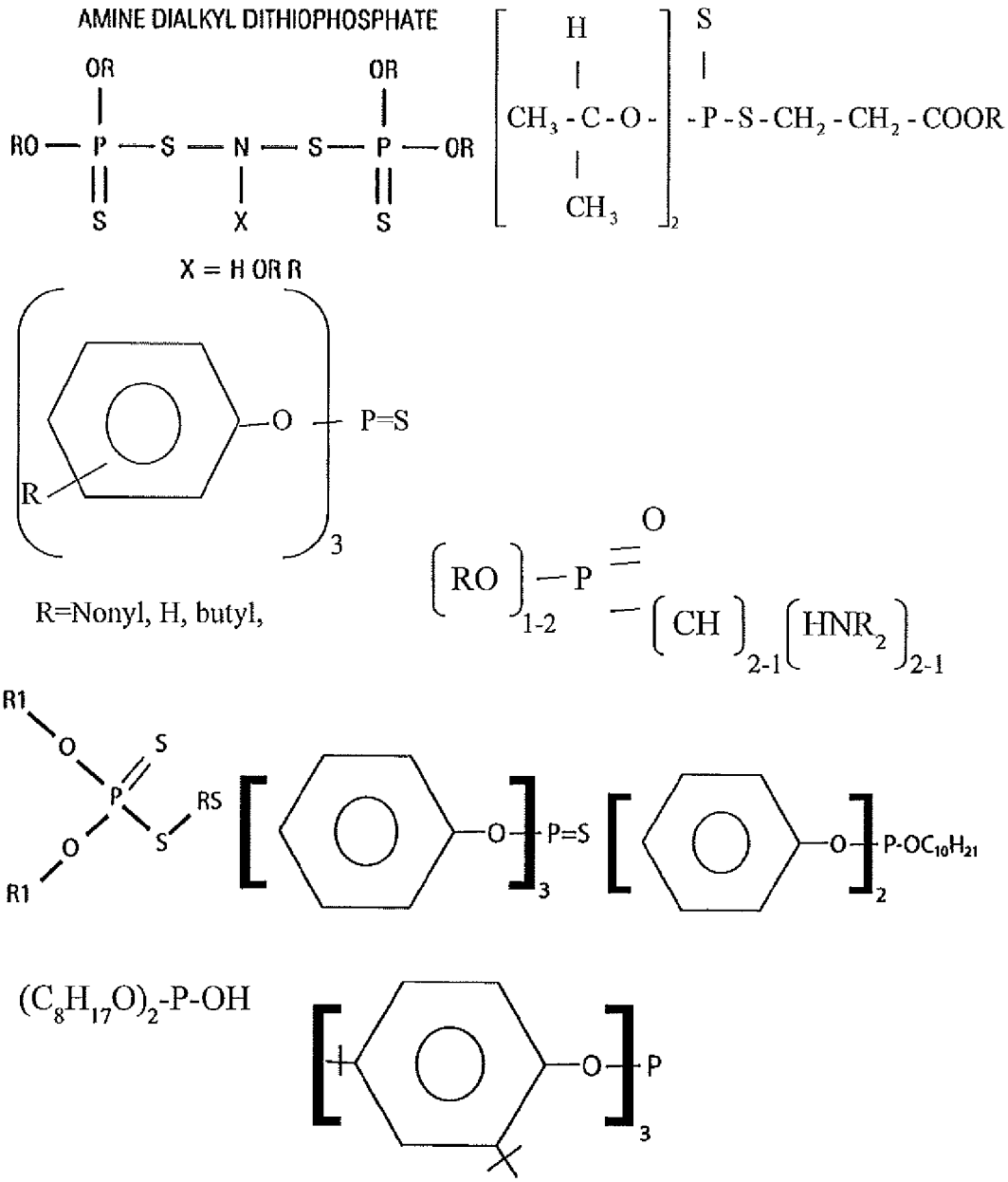
FIG. 4 illustrates formulas for other thiophosphates that are useful in the invention.

Ashless thiophosphate compounds can be of several types. Generally, ashless thiophosphates that have been shown to be effective antiwear additives can be used. For example, fluorothiophosphate (FTP) compounds can be used, such as those of the general formula (RO)(R'O)P(S)F where R and R' comprise the same or different substituents with linear or branched saturated or unsaturated carbon chains (preferably from 1-30 C atoms), substituted or unsubstituted aromatic or cycloaliphatic groups. Fluorothiophosphates are disclosed in U.S. Pat. Nos. 7,074,745 and 8,216,982 for example. Alkylphosphorofluoridothioates are disclosed in US Publication 2011/0319303. Another preferred class of ashless thiophosphates is alkylthioperoxydithiophosphates described in U.S. patent application Ser. No. 13/887,968 filed on May 6, 2013. Examples of one type of fluorothiophosphates are shown in FIG. 3. Other ashless compounds include ashless thiophosphates, phosphates, and phosphonates. FIG. 4 illustrates formulas for other thiophosphates that are useful in the invention.

Mixtures with Ionic Liquids

The invention includes synergistic mixtures of at least one ionic liquid with another component. More specifically, the invention includes synergistic mixtures of MILs with DILs, synergistic mixtures of DILs and DILs, synergistic mixtures of MILs with ashless thiophosphates, synergistic mixtures of DILs with ashless thiophosphates, and synergistic three part mixtures of MILs, DILs, and ashless thiophosphates. The mixtures provide better antiwear activity than the individual components alone The amount of the individual neat components range from 1 to 99%, preferably from 5 to 25% for the minor components.

Mixtures with Ionic Liquids Diluted in Base Oils

The mixtures described above can also be used in combination with one or more base oils. The mixtures are combined with one or more base oils of group I, II, III, IV, or V as defined by the American Petroleum Institute (www.API.org, publication API 1509). The mixtures with ionic liquids are used in an amount of up to 99%, preferably 75%, more preferably 25%, and more preferably between about 1 and about 5% by weight in the base oil.

Additional components can be included in the formulations, such as detergents, dispersants, extreme pressure additives, antiwear additives, antifoam additives, demulsifying agents, corrosion inhibitor, biocides, viscosity index improvers, antioxidants, tackifiers, friction modifiers, emulsifying agents, dyes, thickeners, other surface active substances, and other performance additives.

The examples below serve to further illustrate the invention, to provide those of ordinary skill in the art with a complete disclosure and description of how the compounds, compositions, articles, devices, and/or methods claimed herein are made and evaluated, and are not intended to limit the scope of the invention. In the examples, unless expressly stated otherwise, amounts and percentages are by weight, temperature is in degrees Celsius or is at ambient temperature, and environmental pressure is at or near atmospheric.

Example 1: Combination of 2 DILs

Methods and Materials—Ball-On-Flat Configuration

Ionic liquids were tested by Schwing-Reib-Verschleiss (SRV®) tribometer (Optimol Instruments Prüftechnik, Germany) with reciprocating ball-on-flat configuration. The experiments were performed following the guidelines of the standard method ASTM D 6425-05. According to this procedure, the load applied was 300 N and the experiments lasted 2 hours. Other parameters were: stroke of 1 mm and frequency of 50 Hz. Both balls and discs were purchased from Optimol Instruments Prüftechnik and the quality of the material was certified to be in conformity with international standards. The balls were made of steel AISI 52100 with a diameter of 10 mm, roughness of 0.012 μm, and hardness HRC 63±2. Discs were made of steel AISI 52100 with a diameter of 24 mm, thickness of 7.9 mm, and roughness of 0.56 μm. The initial maximum contact pressure, calculated as suggested by Stachowiak (G W Stachowiak and A W Batchelor. Engineering tribology. 3rd edn. Boston; Butterworth-Heinemann, 2005) for contact between a sphere and a flat surface, was 3.14 GPa. Experiments were performed twice at 50, 100, and 150° C. with neat DILs.

The ball wear scars were examined by optical microscope DM 2500 MH (Leica, Germany), and by SEM-EDS (Scanning Electron Microscopy Energy Dispersive Spectroscopy) analysis with ULTRA FE-SEM (Zeiss, Germany) as described by Pagano et al. Dicationic ionic liquids as lubricants. Proceedings of the Institution of Mechanical Engineers, Part J: Journal of Engineering Tribology November 2012 vol. 226 no. 11 952-964.

Average friction coefficient (COF) was calculated from measuring values after a running-in period of 500 s.

In order to study the thermal degradation of the ILs, Thermogravimetric Analysis (TGA) and Differential Scanning calorimetry (DSC) were applied. The equipment used for thermal analysis was the SDT Q600 (TA Instruments, USA), capable of performing both DSC and TGA simultaneously. The analyses were performed in a dynamic mode, with temperature linearly increasing at a rate of 10° C./min under a constant flow of nitrogen. The TGA and DSC experiments started at ambient temperature and finished at 500° C. The pans used for holding the samples were of platinum. For the characterization by TGA, the start temperature ($T_{start}$) is defined as the temperature where a change in the rate of weight loss can be noticed. The onset temperature ($T_{onset}$) is determined as the intersection of two tangent lines to the curve; the first is taken in its initial steady phase and the second is taken from the area with fast decreasing of weight.

The following DILs were tested (DIL1, DIL2) as well as a 9:1 stoichiometric mixture of the two (DIL1+2). The ball-on-flat configuration was used.

DIL1

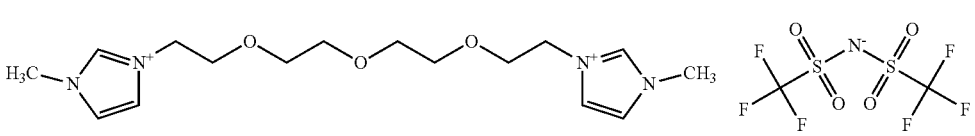

DIL2

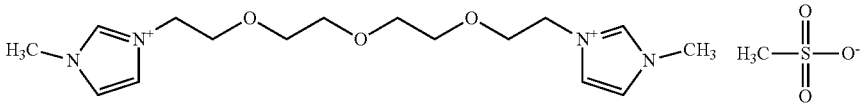

This combination makes use of two cationic groups N-methylimidazolium which are connected by tetraethylene glycol. The cations are paired with bis(trifluoromethanesulfonyl)imide ($Tf_2N$) (DIL1) and methane sulfonate (DIL2) anions.

Results—Thermal Stability

Table I shows the results of thermal analysis. DIL1, DIL2, and DIL1+2 were all stable up to temperatures of at least 150° C., the highest temperature chosen for the tribological measurements. The DILs were in the liquid state at room temperature and no significant phase transitions were detected within the tribological measuring range. The base oil Synalox™ was also measured. Synalox™ is a polypropylene glycol monobutyl ether (CAS 9003-13-8) obtained from The Dow Chemical Company.

TABLE 1

| Fluid | $T_{onset}$ (° C.) | $T_{start}$ (° C.) |
|---|---|---|
| DIL1 | 420 | 365 |
| DIL2 | 355 | 320 |
| DIL1 + 2 | 410 | 350 |
| Synalox ™ | 315 | 250 |

Results—Ball-On-Flat Configuration

Figure 5:
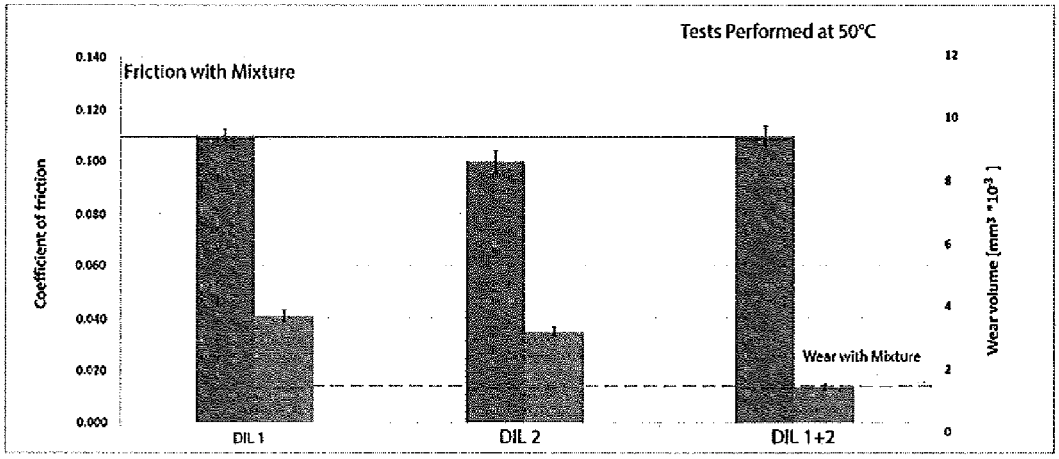
FIG. 5 illustrates the wear and friction results of tests of steel-steel contacts with ball-on-disc configuration using two neat dicationic liquids (DILs) and a mixture of the two at 50° C. Coefficient of friction (COF) is shown on the left and ball wear volume (WV) on the right.
Figure 6:
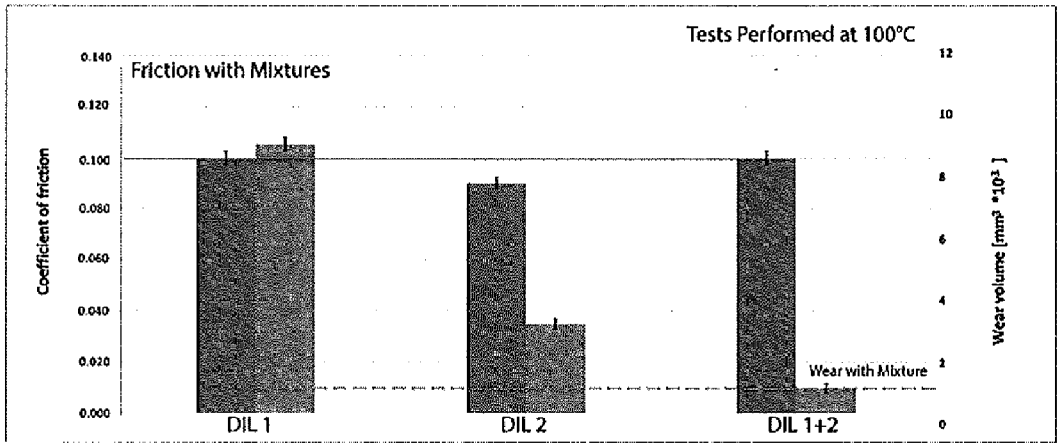
FIG. 6 illustrates the wear and friction results of tests of steel-steel contacts with ball-on-disc configuration using two neat DILs and a mixture of the two at 100° C. Coefficient of friction (COF) is shown on the left and ball wear volume (WV) on the right.
Figure 7:
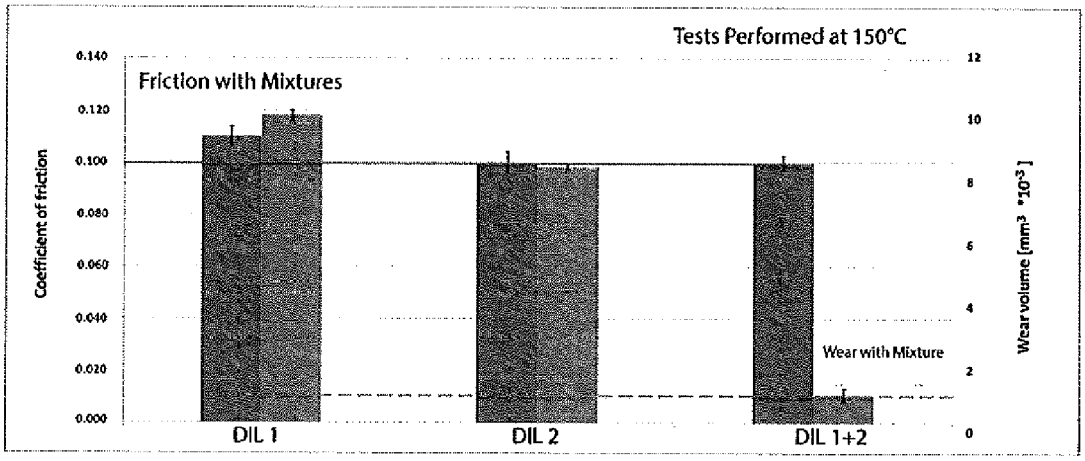
FIG. 7 illustrates the wear and friction results of tests of steel-steel contacts with ball-on-disc configuration using two neat DILs and a mixture of the two at 150° C. Coefficient of friction (COF) is shown on the left and ball wear volume (WV) on the right.

FIGS. 5, 6, and 7 show coefficient of friction (COF) and wear volume (WV) for neat DILs determined at the temperatures 50, 100 and 150° C., respectively. COF is shown on the left, WV on the right. Mean values and standard deviations are shown. At all three temperatures, the mixture has approximately the same COF as each DIL alone but the wear volume is significantly different, illustrating synergistic activity. The wear volume with DIL1+2 was relatively constant at all temperatures, at about $10^{-4}$ $mm^3$.

SEM-EDS analysis was performed on the balls used for the experiments with DIL1+2. At 100° C., only small amounts of oxygen and sulfur were detected in the wear scar area. But at 150° C., both oxygen and sulfur were found in considerable quantities. It can be concluded that there is a change in the tribo-mechanism; at elevated temperature it appears that a more pronounced tribolayer has been originated due to the reactivity of the steel with the sulfur containing anions.

Example 2: Combination of 2 DILs Diluted in Base Oil

Methods and Materials—Configuration

For DILs in base oil, tribometrical experiments and analysis of the wear scars were carried out according to the methods and materials as described in Example 1. The tribometrical experiments were carried out at 100° C.

Synalox™ polypropylene glycol monobutyl ether (CAS 9003-13-8) was used as the base oil for binary mixtures with an overall amount of 1% (w/w) of the DILs.

X-ray Photoelectron Spectroscopy (XPS) was performed using a Thermo Fisher Scientific Theta Probe (East Grinstead, United Kingdom) with a monochromatic Al Kα X-ray source (hν=1486.6 eV). The base pressure during the measurements was consistently at $3\times10^{-9}$ mbar. The samples for the XPS analysis were cleaned directly after the tribological experiment by immersion in toluene in an ultrasonic bath for 15 minutes at room temperature, followed by 2-propanol and petroleum ether for the same duration. Spots in and outside of the worn area of the tribometer discs were defined and analyzed with a spot size of 100 μm at pass energy of 50 eV for the detail spectra and the survey spectra were recorded at 200 eV pass energy. For the imaging XPS experiment, an area of 2.55 $mm^2$ was scanned with a spot and step size of 100 μm, resulting in 285 measurement points. The elements were recorded as snap shots with a 15 eV wide binding energy window and a pass energy of 150.5 eV. The resulting analysis data was processed with the Avantage Data System software, using GaussianlLorentzian peak fitting.

Results—Ball-on-Flat Configuration

Figure 8:
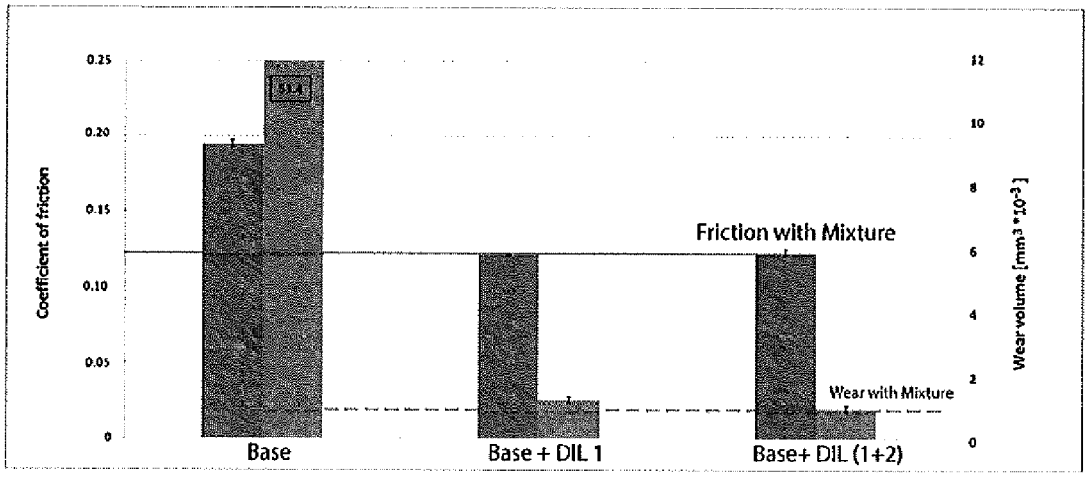
FIG. 8 illustrates the wear and friction results of tests of steel-steel contacts with ball-on-disc configuration using a DIL and a mixture of two DILs diluted at 1% with base oil at 100° C. Coefficient of friction (COF) is shown on the left and ball wear volume (WV) on the right.

The mixture of 2 DILs shows better antiwear properties even when it is added to base oil. This phenomenon is illustrated in FIG. 8, where the behavior of DIL1 alone and DIL1+2 (diluted 1% in base oil) are compared with the behavior of the base oil alone at 100° C. The effect of both DIL1 and DIL1+2 is quite pronounced.

X-ray Photoelectron Spectroscopy (XPS) showed that fluorine content was significantly higher in the worn area than outside. Further investigation of fluorine by a detail scan clearly showed that no organic fluorine was present in this tribologically stressed region. Instead, inorganic fluorine with a binding energy of 684.6 (±0.2) eV was detected, which suggests that the bis(trifluoromethylsulfonypimide anion is completely decomposed under these tribological conditions by the formation of an inorganic fluorine layer. Further sulfidic sulphur was detected at a binding energy of 161.7 (±0.1) eV in the wear track which gives additional evidence for breakup of the anionic structure. The distribution of the binding energies 684.6 (+0.2) eV, inorganic fluorine, and 161.7 (±0.1) eV were investigated by an imaging XPS experiment, which clearly showed that this binding energies are mainly located in the wear track.

The corrosion resistance of the DILs was also investigated by depositing the DILs over the surfaces of steel discs and analyzing the surface after exposure to DIL at 100° C. for one week. DIL1 and the mixture DIL1+2 presented no corrosion and no indication of etched surface. DIL2 presented slight homogeneous corrosion on the area of interest. Here, the corrosion resistance of the mixture is similar to the most stable ionic liquid.

Example 3: Combination of a MIL (P-IL) with an Ashless Fluorothiophosphate (FTP) Diluted in Base Oil Methods and Materials—Ball-on-Flat Configuration A mixture of the MIL choline bis(2-ethylhexyl)phosphate (P-IL) and an FTP was examined using ball on disc configuration. The FTP was an alkylphosphorofluoridothioate, octadecylphosphoro fluoridothioate. The ball-on-flat configuration was used. The structure of the P-IL is shown below.

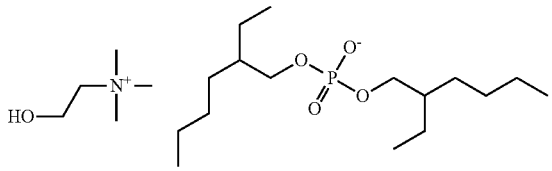

Choline bis(2-ethylhexyl) phosphate
[phosphate IL or P-IL]

P-IL alone and the mixture of the P-IL and the FTP were diluted in a hydrocarbon base oil. The base oil was composed of 60 weight % SN 150W (group I base oil, mineral oil type) and 40 weight % BS 90W (brighstock) to give following viscosities: kinematic viscosity at 100° C.-10.4 $mm^2/s$; kinematic viscosity at 40° C.-87.3 $mm^2/s$, viscosity index −100. The concentration of P-IL and the mixture of the P-IL and the FTP were adjusted to give an overall phosphorus concentration of 1000 mg/kg in the base oil. The ratio was 80% P by P-IL and 20% P by FTP. The tribological test conditions performed on a Schwing-Reib-Verschleiss (SRV®) tribometer (Optimol Instruments Prüftechnik, Germany) with reciprocating ball-on-flat configuration are shown below. Both balls and discs were purchased from Optimol Instruments Prüftechnik and the quality of the material was certified to be in conformity with international standards. All tests with base oil alone and dilutions with MIL and MIL+FTP involved were repeated twice.

TABLE 2

| Variable | Value |
|---|---|
| Specimen: Ball | diameter of 10 mm,<br>material 100Cr6,<br>roughness Ra of 0.012 μm, and<br>hardness HRC 63 ± 2 |
| Specimen: Disc | diameter of 24 mm,<br>thickness of 7.9 mm,<br>material 100Cr6,<br>roughness Rz of 0.56 μm, and<br>hardness HRC 62 |
| Load | 100N |
| Stroke | 1 mm |
| Frequency of reciprocating movement | 50 Hz |
| Duration | 1 hour |
| Temperature | Room temperature (~25° C.) |
| Amount of oil used | ≈0.1 mL |

Wear scar analysis on both disc and ball was performed according to the procedure described by Hunger et al. Tribological characterisation and surface analysis of diesel lubricated sliding contacts. Tribol Schmierungstech 2010; 57:6-13) to provide wear volumina.

Results—Ball-on-Flat Configuration

Table 3 shows the COF and WV results for this example. ZDDP was also tested for comparison.

TABLE 3

| Mixture | Average Friction Coefficient | Wear Volume (Disc) [$\mu m^3$] | Wear Volume (Ball) [$\mu m^3$] |
|---|---|---|---|
| Base Oil | 0.145 ± 0.006 | $1.4 \times 10^6 \pm 1 \times 10^5$ | $4.2 \times 10^4 \pm 2.5 \times 10^4$ |
| Base Oil + P-IL | 0.130 ± 0.002 | $1.6 \times 10^5 \pm 4 \times 10^4$ | $1.1 \times 10^4 \pm 7 \times 10^3$ |
| Base Oil + FTP | 0.131 ± 0.0006 | $1.9 \times 10^5$ | $4.3 \times 10^4$ |
| Base Oil + P-IL + FTP | 0.126 ± 0.0006 | $3.1 \times 10^4 \pm 4 \times 10^3$ | $7.3 \times 10^3 \pm 2.3 \times 10^3$ |
| Base Oil + ZDDP | 0.137 ± 0.001 | $1.7 \times 10^5$ | $4.4 \times 10^5$ |

Figure 9:
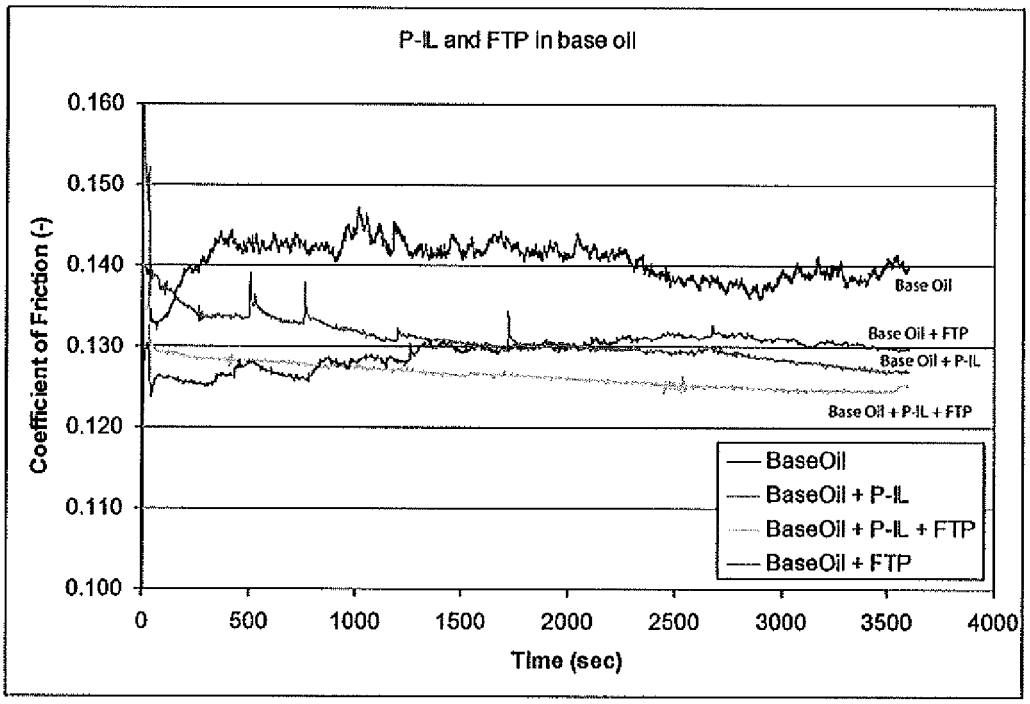
FIG. 9 illustrates the friction results of tests of steel-steel contacts with ball-on-disc configuration using a mixture of P-IL ionic liquid and fluorothiophosphates in base oil.

It is evident from the wear behavior that the friction coefficient in the test decreases from base oil to an oil with P-IL and it is further reduced as FTP is added to the mixture. The wear volume on the flat surface is a good indication of the efficacy of the lubricant in the tribological contact. The wear volume decreases from base oil alone to base oil (BO) with P-IL to base oil with P-IL-FTP (BO=$1.4\times10^6\pm1\times10^5$, BO+P-IL=$1.6\times10^5\pm4\times10^4$, BO+P-IL+FTP=$3.1\times10^4\pm4\times10^3$). Similar trends are seen for the wear behavior of the ball as shown in the table. The synergistic interaction between the P-IL and FTP is responsible for the improved wear behavior. The results are also shown in FIG. 9.

Example 4: Combination of Another MIL (TP-IL) with an Ashless Fluorothiophosphate (FTP) Diluted in Base Oil Methods and Materials—Ball-on-Flat Configuration A mixture of the MIL choline dibutyl dithiophosphate (TP-IL) and an FTP was examined using ball on disc configuration. The FTP was an alkylphosphorofluoridothiolate-octadecylphosphoro fluoridothioate. The ball-on-flat configuration was used. The structure of the TP-IL is shown below.

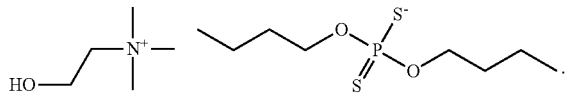

Choline dibutyl dithiophosphate
[dithiophosphate IL or TP-IL]

TP-IL and the mixture of the TP-IL and the FTP were diluted in a hydrocarbon base oil. The composition of the base oil was identical with that given in Example 3. The concentration of TP-IL and the mixture of the TP-IL and the FTP were adjusted to give an overall phosphorus concentration of 1000 mg/kg in the base oil. The ratio was 80% P by TP-IL and 20% P by FTP. The tribological test conditions were performed as described in Example 3.

Results—Ball-on-Flat Configuration

Table 4 shows the results for COF and wear scar evaluation for the base oil+TP-IL, base oil+FTP, base oil+TP-IL+FTP, and base oil+ZDDP.

TABLE 4

| Mixture | Average Friction Coefficient | Wear Volume (Disc) [$\mu m^3$] | Wear Volume (Ball) [$\mu m^3$] |
|---|---|---|---|
| Base Oil | 0.145 ± 0.006 | $1.4 \times 10^6 \pm 1 \times 10^5$ | $4.2 \times 10^4 \pm 2.5 \times 10^4$ |
| Base Oil + TP-IL | 0.125 ± 0.001 | $2.6 \times 10^5 \pm 1.4 \times 10^5$ | $3.2 \times 10^4 \pm 3 \times 10^4$ |
| Base Oil + FTP | 0.131 ± 0.0006 | $1.9 \times 10^5$ | $4.3 \times 10^4$ |
| Base Oil + TP-IL + FTP | 0.128 ± 0.001 | $1.2 \times 10^5$ | $1.8 \times 10^4 \pm 9 \times 10^3$ |
| Base Oil + ZDDP | 0.137 ± 0.001 | $1.7 \times 10^5$ | $4.4 \times 10^5$ |

Figure 10:
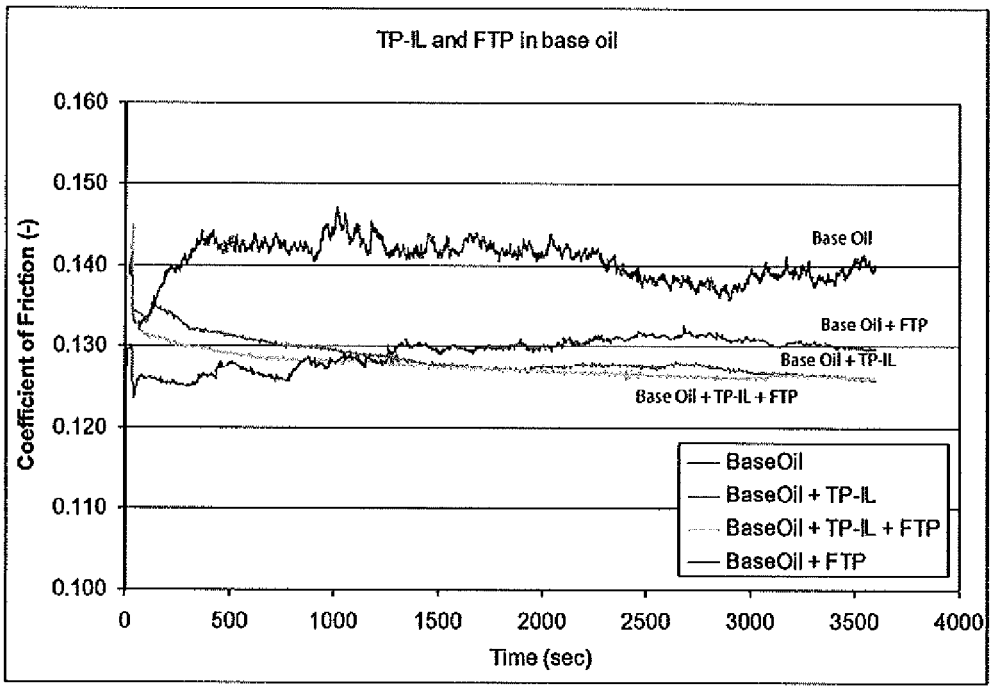
FIG. 10 illustrates the friction results of tests of steel-steel contacts with ball-on-disc configuration using a mixture of TP-IL ionic liquid and fluorothiophosphates in base oil.

The COF decreased from base oil alone to base oil with TP-IL and it was further reduced when FTP was added to the mixture. The wear volume on the flat surface is a good indication of the efficacy of the lubricant in the tribological contact. The wear volume also decreased from base oil alone to base Oil with TP-IL to base oil with TP-IL+FTP (BO=$1.4\times10^6\pm1\times10^5$, BO+TP-IL=$2.6\times10^5\pm1.4\times10^5$, BO+TP-IL+FTP=$1.2\times10^5$). Similar trends were seen with the wear behavior of the ball as shown in the table. The synergistic interaction between the TP-IL and FTP is responsible for the improved wear behavior. The results are also shown in FIG. 10.

Modifications and variations of the present invention will be apparent to those skilled in the art from the forgoing detailed description. All modifications and variations are intended to be encompassed by the following claims. All publications, patents, and patent applications cited herein are hereby incorporated by reference in their entirety.

What is claimed is:

1. An anti-wear and/or friction reducing formulation comprising a mixture of at least one ionic liquid and at least one ashless antiwear compound, wherein the ionic liquid has the formula $A^-C^+$-P-$C^+A^-$ wherein $C^+$ are cations, $A^-$ are the same or different anions, and P is an ethylene glycol with 1 to 300 repeating units, wherein the ashless antiwear compound comprises an ashless fluorothiophosphate and is present at about 1 to 25% by weight, wherein the ionic liquid is an alkylphosphate ionic liquid, and wherein the formulation provides synergistic anti-wear and/or friction reducing properties.

2. The formulation of claim 1, wherein the fluorothiophosphate is an alkylphosphorofluoridothioate.

3. The formulation of claim 1, wherein the number of repeating units for P ranges from 2 to 100.

4. The formulation according to claim 1, wherein the anions of the ionic liquid are selected from a dialkylphosphate, a dialkyldithiophosphate, a bis(trifluoromethylsulfonyl)imide, and an alkylsulfonate.

5. The formulation according to claim 1, wherein the cation of the ionic liquid is choline.

6. An antiwear and/or friction reduction formulation comprising the formulation of claim 1 diluted up to 25% by weight in a base oil.

7. A method of providing antiwear protection and/or friction reduction comprising using the formulation of claim 1.

8. The formulation of claim 1, wherein the amount of ionic liquid in the formulation is more than the amount of ashless antiwear compound in the formulation.

9. The formulation of claim 1, wherein the synergistic effect of the formulation amounts to at least 20% reduction in wear volume compared to the addition of the effects of ionic liquid and ashless fluorothiophosphate antiwear compound without the synergy.

10. The formulation of claim 1, wherein the synergistic effect of the formulation amounts to at least 50% reduction in wear volume compared to the combined effects of ionic liquid and ashless fluorothiophosphate antiwear compound without the synergy.

11. The formulation of claim 6, wherein the overall phosphorus concentration in the formulation is more than 500 mg/kg in the base oil.

12. The formulation of claim 1, wherein the amount of phosphorus in ionic liquid is defined as the ionic liquid phosphorus amount and the amount of phosphorus in ashless antiwear compound is defined as the antiwear phosphorus amount and the ionic liquid phosphorus amount is greater than the antiwear phosphorus amount in the formulation.

13. The formulation of claim 1, wherein the ratio of ionic liquid phosphorus amount and antiwear phosphorus amount is more than 3:2.

14. The formulation of claim 1, wherein the ratio of ionic liquid phosphorus amount and antiwear phosphorus amount is more than 2:1.

15. The formulation of claim 1, wherein the ratio of ionic liquid phosphorus amount and antiwear phosphorus amount is more than 3:1.

16. An anti-wear and/or friction reducing formulation comprising a mixture of at least one ionic liquid and at least one ashless antiwear compound, wherein the ionic liquid has the formula $A^-C^+$-P-$C^+A^-$ wherein $C^+$ are cations, $A^-$ are anions, and P is an ethylene glycol with 1 to 300 repeating units, wherein the ionic liquid is a dialkylphosphate ionic liquid and the amount of ionic liquid in the formulation is more than the amount of ashless antiwear compound in the formulation, wherein the ashless antiwear compound comprises an ashless alkylphosphorofluoridothioate and is present at about 1 to 25% by weight, wherein the formulation provides synergistic anti-wear and/or friction reducing properties that amounts to at least 20% reduction in wear volume compared to the addition of the effects of ionic liquid and ashless thiophosphate antiwear compound without the synergy, and wherein the amount of phosphorus in ionic liquid is defined as the ionic liquid phosphorus amount and the amount of phosphorus in ashless antiwear compound is defined as the antiwear phosphorus amount and the ionic liquid phosphorus amount is greater than the antiwear phosphorus amount in the formulation.

17. The formulation according to claim 16, wherein the cation of the ionic liquid is choline.

18. An antiwear and/or friction reduction formulation comprising the formulation of claim 16 diluted up to 25% by weight in a base oil.

19. The formulation of claim 18, wherein the overall phosphorus concentration in the formulation is more than 500 mg/kg in the base oil.

20. The formulation of claim 16, wherein the ratio of ionic liquid phosphorus amount and antiwear phosphorus amount is more than 3:2.

* * * * *